United States Patent [19]

Hart et al.

[11] 4,324,089

[45] Apr. 13, 1982

[54] HORSE CONTROL LEADER

[76] Inventors: Lena M. Hart; Ronald J. Hart; Guy D. Hart, All of 7712 Saulsbury St., Arvada, Colo. 80003

[21] Appl. No.: 106,557

[22] Filed: Dec. 26, 1979

[51] Int. Cl.[3] ..... B68B 1/02

[52] U.S. Cl. ..... 54/24

[58] Field of Search ..... 54/24, 6 R, 34, 69; 119/118

[56] References Cited

U.S. PATENT DOCUMENTS

| | | | |
|---|---|---|---|
| 675,014 | 5/1901 | Raeuchle | 54/24 |
| 815,164 | 3/1906 | Hayner | 54/24 |
| 964,947 | 7/1910 | Varney | 54/24 |
| 1,215,357 | 2/1917 | Estes | 54/6 R |
| 1,804,655 | 5/1931 | Swanjord | 54/24 |
| 3,731,456 | 5/1973 | Hill | 54/24 |

*Primary Examiner*—Hugh R. Chamblee
*Attorney, Agent, or Firm*—Young & Martin

[57] ABSTRACT

A control leader for horses is adapted to mount onto a horse's head either solely or in conjunction with a standard horse halter. The control leader includes a brow member and a crown member which encircle the horse's ears and which are interconnected at a position immediately beneath the horse's ears on opposite sides of the horse's head, and a flexible leader member which is attached to the brow and the crown members beneath the horse's ear, which leader member hangs freely therefrom so as to have a looped portion in freely hanging, spaced-apart relation to the horse's throat. The crown member is substantially rigid in a direction normal to its longitudinal axis so that it has a substantially non-deformable cross-section. This crown member is preferably formed of wire or chain.

7 Claims, 4 Drawing Figures

HORSE CONTROL LEADER

BACKGROUND OF THE INVENTION

In the past, a variety of horse halters have been devised for the purpose of controlling a horse during either equestrian activities such as riding the horse or for purposes of controlling the horse's movement during handling and tethering. While a panoply of such devices have been used, until the present time, none have proved adequate to control a frightened horse during the loading of the horse onto a trailer or at other times when the horse becomes excessively agitated.

The particular problem that has confronted those who handle horses is that, when a horse becomes excessively agitated, the horse rears its head and when the horse so acts in this unruly manner, there is danger to the handler. This danger is readily apparent when one considers the relative strength of the horse versus the human handler. As has been noted in the prior art, and is known in the field of horse handling, a horse may be best controlled when its head is prevented from rearing. For example, U.S. Pat. No. 3,906,707, issued Sept. 23, 1975 to Morgan identified the problems associated with a horse's rearing of its head. Morgan provides a mechanical tie-down strap of predetermined length connected between the belly strap beneath the horse's flank and the halter. This strap or rope mechanically prevents the horse from rearing or raising its head beyond the positive limit provided by the particular length of the strap. While this device is effective to prevent the horse from raising its head to an undesired degree, it allows completely free, unrestrained upward movement of the head up to the limit and an abrupt, unyielding stop at the limit. Consequently, it does not have a calming effect on the horse and, indeed, may have the contrary effect of agitating the horse to a greater degree.

The problem of a horse's rearing its head was also recognized in U.S. Pat. No. 649,314 issued May 8, 1900 to Kelly, and this patent discloses an undercheck device for horses including a yoke positioned on the horse's neck and overcheck rein which extends over the top of the horse's head. This apparatus mechanically restrains the motion of the horse's head so that the horse can neither lower its head unduly or rear its head. However, this device which is designed for use when the horse is ridden, does not prevent the horse from being agitated and is not effective for controlling the horse when it is being lead into a trailer.

It has long been recognized that a horse has various pressure points on its head located immediately behind and to the side of its ears. When pressure is applied to these areas of a horse's head, the horse is somewhat discomforted but is not physically harmed. It has also been found by the applicant, that, when the horse is highly agitated as a result of events occurring in its surroundings, such as during loading the horse on a trailer, the application of pressure to these locations on the horse exerts a calming influence on the horse, since it distracts the horse from those events that are making the horse irritated. It should be pointed out that, while existing halters or leaders do have straps that extend around the ear, their conventional wide, flexible structure prevents exertion of sufficient pressure on these sensitive areas to result in this calming influence.

SUMMARY OF INVENTION

It is therefore an object of the present invention to provide a novel horse control leader which facilitates manual exertion of a steady controllable pressure behind the ears of a horse sufficient to distract the horse from its surrounding events while not physically damaging the animal.

It is another object of the present invention to provide a novel horse control leader that can be used in conjunction with a standard halter or bridle and which, when used, will calm the horse and prevent the horse from rearing its head.

A further object of the present invention is to provide a horse control leader which may be used in conjunction with a standard halter and which facilitates the loading of the horse into a horse trailer.

A still further object of the present invention is to provide a novel horse control leader which includes a crown member which is flexible along its longitudinal axis to conform to the curvature of a horse's head, but which is non-deformable in cross-section so as to exert substantial pressure to the portion of the horse's head immediately behind and below the horse's ears.

The present invention is a novel and improved horse control leader which is formed as a rigging, including a brow strap, a crown strap and an elongated connecting leader, which rigging is adapted to be positioned over a horse's head either alone or in conjunction with a horse halter. The brow member extends across the forehead of the horse and has opposite ends which terminate on the sides of the horse's head immediately below the horse's ear. The crown member is connected at each of its ends to the ends of the brow member so that the combined assembly encircles the horse's ears. The leader member is attached at its opposite ends to the respective common connections between the brow member and the crown member, and the leader member is adapted to hang as a looped portion beneath the horse's neck so that the lower portion is in free-hanging, spaced-apart relation to the throat or undersurface of the horse's head. The significant departure of the present invention from the prior art resides in the construction of the crown piece or member which is formed so as to exert a controlled pressure on the pressure sensitive areas of a horse behind its ears. To accomplish this function, the crown member is preferably formed as either a thick, cylindrical wire or as a chain so that it is flexible along its length or longitudinal axis to conform to the shape of the horse's head while having a substantially non-deformable cross-section. By being so constructed, when a downward force is exerted on the control leader, the crown member presses against the horse's head at a position behind the horse's ears in a line extending from ear to ear, and the downward pressure can be manually controlled to the requisite magnitude and extent to effect the necessary distraction.

This construction is particularly adapted and suitable to allow a person to exert enough force in a controlled manner on the pressure areas adjacent the horse's ears so that, when the horse is frightened or agitated, the application of force will distract the horse from its surroundings so as to create a calming influence. In other words, the horse's attention is transferred from its surroundings to the discomfort caused by the control leader so that it ceases to be frightened or agitated since the horse is concentrating more on the discomfort caused by the device. It should be stressed, however, that this device does not cause any physical damage to the horse so that it may be used with a variety of horses, including those bred for show.

Also, by so constructing a crown piece, the horse will also cease from rearing its head since it will not pull against a sharp pressure applied to the sensitive pressure points around its ears. Hence, the user of the apparatus may exert more control over the horse than has heretofore been possible with standard, "soft strap" halters. As noted above, these standard or conventional halters include ropes or straps which extend behind the horse's ears. However, this conventional construction does not apply sufficient pressure to the sensitive areas on the horse's head since the straps exhibit a large degree of give about their cross-section, that is, they are soft and deformable in cross-section and have a large area of surface contact with the crown of the horse. Since the key to the present apparatus's operability is the control of the horse through distracting its concentration and through its discomfort, persons using existing prior art halters generally are incapable of providing a sufficient directed force about the sensitive area behind the ears.

In the preferred embodiment of this invention, the crown member may be made of a wire or chain, since both of these constructions allow a sufficiently sharp directed force or pressure concentrated on the sensitive areas while the brow and leader straps may be formed in any convenient manner, such as, with rope, leather strapping, or chain.

These and other objects of the invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
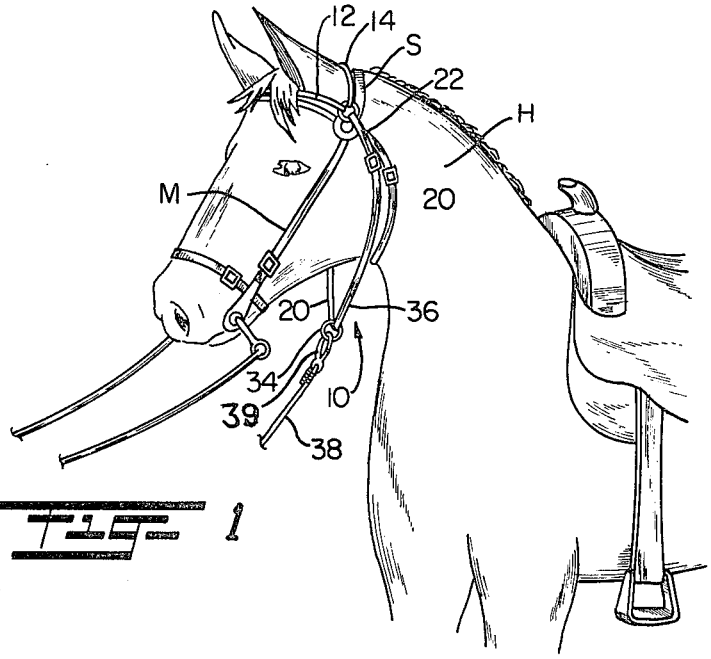
FIG. 1 is a perspective view of the preferred embodiment of the present invention shown positioned on a horse.
Figure 2:
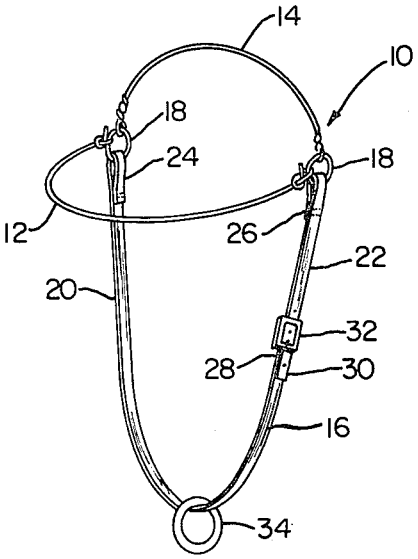
FIG. 2 is a view in perspective of the preferred embodiment of the present invention.
Figure 3:
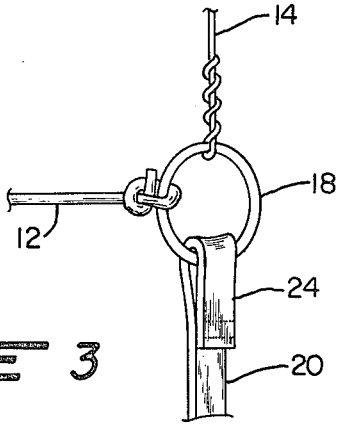
FIG. 3 is an enlarged view in perspective of three attached ends of the various members forming the rigging of the preferred embodiment of the present invention.

The preferred embodiment of the novel horse control leader according to the present invention is shown positioned on a horse in FIG. 1 and illustrated in greater detail in FIGS. 2 and 3. Specifically, as shown in FIG. 2, control leader 10 comprises a rigging adapted to be positioned over the head of the horse. Control leader 10 has a brow member 12, a crown member 14, and a leader member 16 each having ends attached to an end of the other rigging members by means of a pair of metal rings 18. In the preferred embodiment, brow member 12 is formed as a band or strand of rope having its opposite ends securely knotted to rings 18, as is more clearly shown in FIG. 3.

The construction of crown member 14 is important, as will be more fully discussed below, but in the preferred embodiment, crown member 14 is formed as a flexible wire having opposite ends secured to rings 18 by inserting each end through a respective ring 18, doubling the ends of the wire back on itself and twisting the free end around the main body of the wire. The wire forming crown member 14 is flexible along its length but substantially rigid about its cross-section.

Leader member 16 is preferably formed as a pair of leather straps 20 and 22 with each of the straps being secured to a respective metal ring 18. Leather strap 20 is somewhat longer than strap 22 and has a looped end 24 attached to one ring 18 and is formed by inserting a free end through a ring 18 and then looping the free end back along the main body of strap 20 where it is sewn or attached in any other convenient manner, as shown in FIG. 3. Similarly, leather strap 22 has a loop end 26 secured to the other of rings 18 with this loop end being formed as an end portion of strap 22 which is inserted through a ring 18, looped back along the main body of strap 22 and secured to itself by means of stitching or other convenient forms of attachment. End 28 of strap 20 opposite end 24 is attached in any convenient manner to a standard metal buckle 32, and buckle 32 is adapted to receive a free end 30 of strap 22 opposite end 26. Strap 20 extends through a large metal ring 34 and, when attached to strap 22 this rigging defines an elongated flexible loop which is adapted to hang beneath the horse's throat or neck is spaced relation thereto as shown in FIG. 1.

As noted, control leader 10 is adapted to be positioned upon the head of the horse H, as shown in FIG. 1. It should be appreciated that control leader 10 can be mounted on a horse independently of a halter, but it can also be positioned on the head of a horse in conjunction with a halter M, as is the case shown in FIG. 1. Brow member 12 and crown member 14 are dimensioned so that they are adapted to be positioned with brow member 12 extending across the horse's forehead immediately forward of the horse's ears with crown member 14 extending across the back of the horse's head immediately behind the horse's ears so that rings 18 lie on opposite sides of the horse's head immediately beneath the horse's ears. Straps 20 and 22 are of sufficient length so that, when brow member 12 and crown member 14 are so positioned as shown in FIG. 1, straps 20 and 22 form a free hanging loop 36 having a lower portion that is in spaced apart relation to the throat of the horse with metal ring 34 located at the lower extremity of loop 36. A rope 38 having a standard releasable fastener 39 may then be attached to ring 34 as shown in FIG. 1. When used in conjunction with a halter M, as shown in FIG. 1, it is essential that crown member 14 lie between the crown strap S of halter M and the horse's ears, with crown member 14 contacting the horse's head along the length of crown member 14.

While it should be noted that the brow member 12 and the leader formed by straps 20 and 22 may be constructed of any suitable materials, such as, leather straps, ropes, chain, and the like, the construction of the crown member is important for the control leader 10 to be suitably operated to exert a controlling influence over a horse. Specifically, it is important that crown member 14 be formed of a material that is flexible along its length yet substantially rigid or non-deformable about its cross-section. In other words, crown should be rigid in directions normal to its surface. To this end, it has been found acceptable to use a single strand of metal wire, a multistrand metallic cable, or a chain having metal or plastic links. In addition, it is contemplated that other suitable materials known in the art would be acceptable in constructing crown member 14 provided that such material has a substantially non-deformable cross-section.

Horse handlers have long recognized that a horse possesses certain sensitive areas on the crown of its head immediately behind its ears which, when stimulated by pressure, cause the horse some discomfort while not physically damaging the animal. When the animal becomes excessively agitated and exhibits violent motions of its head, applicant has found that the application of a downwardly directed force to loop 36 causes crown member 14 to apply significant pressure to these sensitive areas behind the horse's ears. The ensuing discomfort has a two-fold effect which calms the animal. First, the horse seeks to avoid the pressure thereby chooses to refrain from excessively rearing its head, and second, the horse, because of its discomfort, is distracted from the external stimuli which has so far caused it to become agitated. To this end, it is essential that crown member 14 exert significant pressure along a line extending across the crown of the horse behind the horse's ears.

Whereas existing horse halters have had crown straps that are positioned somewhat behind the horse's ears, these straps have not been designed to exert such pressure and, indeed, have been constructed of very pliant and soft materials designed specifically not to cause the horse discomfort. This fact should be appreciated when it is realized that conventional horse halters are often designed to be used while riding the horse while the present invention is specifically adapted to be used only in controlling the horse such as, during the loading of the horse onto a trailer, and is not designed to be used when the horse is ridden in an ordinary manner. Further, it has been found that conventional halters are completely ineffective in attempting to control a horse in the manner contemplated by use of the present invention.

Figure 4:
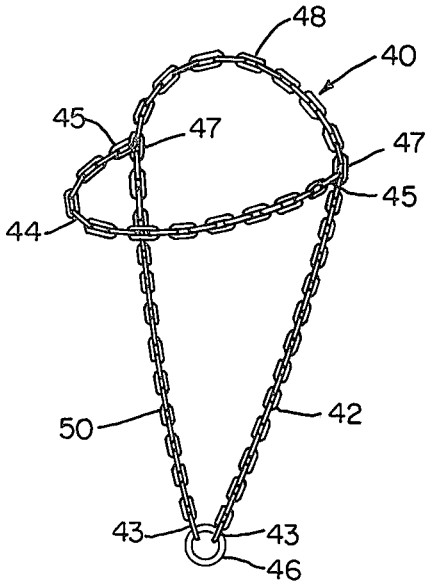
FIG. 4 is a perspective view of an alternate embodiment of the present invention.

An alternate embodiment of the present invention is shown in FIG. 4, and this construction has the advantage of ease and economy in manufacture while functioning in an equivalent manner with that shown as the preferred embodiment shown in FIGS. 1-3. As is shown in FIG. 4, horse control leader 40 is formed by two chains, 42 and 44. Chain 42 is substantially longer in dimension than chain 44 and has its end links 43 connected to a metal ring 46 thereby forming a closed loop. Chain 44 has its end links 45 attached to connecting links 47 of chain 42 so that chain 42 is divided into a crown portion 48 and a leader portion 50 with chain 44 forming a brow chain. When positioned on a horse, crown portion 48 of chain 42 extends behind the horse's ears and brow chain 44 extends across the horse's forehead immediately forward of the horse's ears. In this manner, connecting links 47 lie beneath the horse's ears on opposite sides of its head. Leader portion 50 then hangs in a free loop beneath the horse's neck so that ring 46 is positioned for convenient attachment of a rope 38 as described with respect to the preferred embodiment. It is often desirable, in constructing leader portion 50 that ring 46 be freely movable along leader portion 50 between links 47. To accomplish this, links 43 are interconnected with leader portion 50 extending through ring 46 in a manner similar to strap 20 and ring 34 in FIG. 2.

With this construction, it should be appreciated that control leader 40 may be easily slipped over the horse's head and positioned with brow chain 44 and crown portion 48 on the forward and rearward of the horse's ears, respectively, in a manner similar to that described with respect to FIG. 1. Chain 42 should be constructed of links having a largest cross-sectional dimension less than 1.5 cm. It has been found that, by keeping the largest cross-sectional dimension of the crown member 14 or crown portion 48 less than 1.5 cm, a sufficient pressure is placed around the sensitive area around the horse's ears such that the horse may be conveniently controlled.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

I claim:

1. A horse control leader for horses adapted for applying uniform pressure to a portion of a horse's head immediately behind its ears, comprising a rigging including a browband having a pair of opposed ends dimensioned to be positioned on the horse with said opposed ends each being immediately beneath the ears of the horse on opposite sides of the horse's head, a crown member having opposite ends respectively connected to said opposed ends of the browband and adapted to extend over the top of the horse's head immediately behind the horse's ears, and an elongated flexible leader having opposite ends connected to said opposed ends of the browband, said leader member sized to form a free-hanging loop having a lower portion in spaced-apart relation to the throat of the horse whereby force applied downwardly on said loop directly causes uniform tension in said crown member to apply said uniform pressure, said crown member having a substantially non-deformable cross-section and flexible along its length.

2. A control leader according to claim 1 wherein said crown member is a solid cylindrical wire flexible in a longitudinal direction.

3. A control leader according to claim 1 wherein said crown member is a chain having its end links connected to the ends both of said browband and said leader member.

4. A control leader according to claim 1 wherein said crown member and said leader member are formed as a continuous closed loop of chain, said browband being a chain having opposite end links connected to the end links of an arced portion of said closed loop, said end links of the arced portion defining said opposite ends of said leader member and said crown member.

5. A control leader according to claim 1 including connecting ring on a lower portion of said free-hanging loop, said ring having a diameter larger than the largest dimension of said leader member's cross-section.

6. A control leader for horses adapted for applying uniform pressure to a portion of a horse's head immediately behind its ears, comprising:

an elongated brow member dimensioned to extend across the forehead of a horse at a location forward of the horse's ears and having opposite ends positioned beneath the horse's ears when said control leader is placed on the horse's head;

an elongated crown member having a substantially non-deformable cross-section and having ends each secured to a respective one of the ends of said brow member; and an elongated flexible leader member for applying tension on opposite ends of said crown member, said leader member having ends thereof each secured to a respective one of the ends of said brow member and including a lower looped portion freely hanging in spaced relation to the horse's head when said control leader is placed thereon whereby downwardly directed force on said looped portion applies said tension to apply said uniform pressure.

7. A control leader according to claim 6 wherein said crown member is a flexible chain having links of a width less than 1.5 cm.

* * * * *